US007021825B1

(12) United States Patent
Schultz

(10) Patent No.: US 7,021,825 B1
(45) Date of Patent: Apr. 4, 2006

(54) PORTABLE CONTAINER FOR TEMPORARY STORAGE OF SMALL OBJECTS USED WITH INFANTS AND CHILDREN

(76) Inventor: Heather Clare Schultz, 5310 Southerly Way, Sarasota, FL (US) 34232

( * ) Notice: Subject to any disclaimer, the term of this patent is extended or adjusted under 35 U.S.C. 154(b) by 0 days.

(21) Appl. No.: 10/825,511

(22) Filed: Apr. 14, 2004

(51) Int. Cl.
*B65D 33/28* (2006.01)

(52) U.S. Cl. ..... 383/76; 248/311.2; 224/438

(58) Field of Classification Search ..... 248/311.2, 248/682, 689, 693, 309.1, 318; 383/76, 117, 383/6, 9, 12; 224/438, 436
See application file for complete search history.

(56) References Cited

U.S. PATENT DOCUMENTS

| | | | | | |
|---|---|---|---|---|---|
| 599,119 | A | * | 2/1898 | Coolidge | 224/438 |
| 752,004 | A | * | 2/1904 | Simons | 224/436 |
| D147,587 | S | * | 9/1947 | Kaplan | D6/564 |
| 2,616,468 | A | * | 11/1952 | Brady | 383/117 |
| 2,682,290 | A | * | 6/1954 | Ditlea | 383/121 |
| 2,705,517 | A | * | 4/1955 | Elsas | 206/459.5 |
| 2,920,670 | A | * | 1/1960 | Mohlmann | 383/9 |
| 3,888,486 | A | * | 6/1975 | Sutter et al. | 273/400 |
| 3,982,687 | A | * | 9/1976 | Auer et al. | 383/204 |
| 4,228,834 | A | * | 10/1980 | Desnick | 383/13 |
| 4,548,375 | A | * | 10/1985 | Moss | 248/205.2 |
| 4,775,082 | A | * | 10/1988 | Krache | 224/219 |
| 4,941,480 | A | * | 7/1990 | McLean et al. | 128/878 |
| 4,979,833 | A | * | 12/1990 | Cook | 383/12 |
| 5,050,999 | A | * | 9/1991 | Van Loon, III | 383/76 |
| 5,215,379 | A | * | 6/1993 | Pickard et al. | 383/37 |
| 5,259,541 | A | * | 11/1993 | Reese | 224/663 |
| 5,325,991 | A | * | 7/1994 | Williams | 220/739 |
| 5,407,111 | A | * | 4/1995 | Lanouette et al. | 224/579 |
| 5,699,564 | A | * | 12/1997 | Heh | 5/503.1 |
| 5,909,833 | A | * | 6/1999 | Smith | 224/577 |
| 5,967,345 | A | * | 10/1999 | Subotin | 211/119.007 |
| 6,004,033 | A | * | 12/1999 | Cirone | 383/24 |
| 6,145,715 | A | * | 11/2000 | Slonim | 224/148.3 |
| 6,286,798 | B1 | * | 9/2001 | Chun | 248/311.2 |
| 6,467,665 | B1 | * | 10/2002 | Jenkins | 224/628 |
| 6,478,464 | B1 | * | 11/2002 | Miller | 383/76 |
| D475,198 | S | * | 6/2003 | Kim | D3/306 |
| 6,766,930 | B1 | * | 7/2004 | Dixon et al. | 224/409 |
| 6,942,130 | B1 | * | 9/2005 | Duva | 224/407 |
| 2002/0148868 | A1 | * | 10/2002 | Dion-Bildstein et al. | 224/401 |

* cited by examiner

*Primary Examiner*—Anita M. King
(74) *Attorney, Agent, or Firm*—Dorothy S. Morse

(57) ABSTRACT

A washable container made from soft flexible material, including open-weave fabric, with a top opening and optionally removable straps with fasteners that allow attachment to cribs and other baby-holding devices, such as portable play yards, swings, highchairs, and strollers. The top opening is configured for insertion of a large adult male hand, and the container height provides an interior volume sufficient for storing approximately one dozen or so pacifiers, several teething devices, or other small toys that babies and small children often drool on, drop on the ground, cover with food, and/or otherwise need cleaning prior to being returned to them. Thus, unsanitary pacifiers, toys, and teething devices can be placed in a disposable plastic bag, clothing pocket, diaper bag pocket, or other temporary storage place, with a clean pacifier, teething device, or other small toy being instantly substituted from the readily accessible and conveniently located present invention.

20 Claims, 4 Drawing Sheets

PORTABLE CONTAINER FOR TEMPORARY STORAGE OF SMALL OBJECTS USED WITH INFANTS AND CHILDREN

CROSS-REFERENCES TO RELATED APPLICATIONS

None.

BACKGROUND OF THE INVENTION—FIELD OF THE INVENTION

This invention relates to the field of baby products, specifically to a washable container with a top opening that is made from soft material, including mesh fabric such as but not limited to nylon net, and has a combination of fasteners that allow prompt and easy attachment to a crib, nearby wall surface, or other baby-holding device, such as a portable play yard, swing, highchair, changing table, or stroller. The top opening would be sufficient in size for insertion therethrough of a large adult male hand, and the height of the container would provide an interior volume suitable for the storage of approximately a dozen or so pacifiers, several teething devices, and/or other small toys that a baby or small child would be likely to drool on, drop on the ground, cover with food, and/or otherwise require cleaning prior to being returned to the child. Thus, through use of the present invention the adult can place the unsanitary pacifier, toy, or teething device in a plastic bag, pocket, diaper bag pocket, or other temporary storage place until the adult finds time to clean it, and immediately substitute a clean pacifier, teething device, or other small toy that is retrieved from the readily accessible and conveniently located present invention.

BACKGROUND OF THE INVENTION—DESCRIPTION OF THE RELATED ART

Babies and small children typically lack coordination and as a result they are continually dropping things they hold in their hands onto the ground and other unsanitary surfaces. However, lack of muscular coordination is not the only reason for dropped objects. Babies and children also drop objects as they experiment and test things to learn how they react, when they get excited about seeing something else they want, and while generally playing games and interacting with adults and other children. Also, once something is in the hands of babies and small children, it almost always tends to find its way into their mouth. Thus, when the objects in possession of small children and babies are dropped, the objects are usually covered with saliva and/or food, and therefore readily pick up dirt, carpet fuzz, dog hair, and the like from the floor or ground before they can be retrieved. Further, if a dropped object is not properly cleaned before it is given back to a baby or small child, the probability of the child placing it back into its mouth is high and any remaining dirt/debris on the object could become a source of illness for the child. Therefore, to protect the child, once an object is dropped onto an unsanitary surface, it should not be given back to the child until it can be thoroughly cleaned. However, this presents a dilemma for the parent or other person caring for a baby or small child while away from home, about what to do if the child misses the pacifier, teething device or toy, and cries inconsolably. A replacement pacifier, teething device or toy retrieved from a clothing pocket is not always sanitary, as keys, money, and other potentially germ-laden objects may have been previously stored in the pocket.

While replacement objects can be stored in a diaper bag, such bags are typically large and time consuming to access on a repeated basis. Another problem is encountered during the night when a baby or small child wakes up and cries because it has lost its pacifier or favorite toy. A sleepy parent cannot always readily find the lost item in the child's bedding. A quick, easy, and convenient solution would be to have a small container stored close to the location of need, for ready availability, with a top opening sufficiently large for a parent to easily withdraw one or more small objects in an attempt to comfort the awakened child or small baby and promptly get that child or baby back to sleep. Thus, if the present invention was attached in a pre-determined location on a child's crib every night, and filled before bedtime with several pacifiers and/or comforting small toys or teething devices for the child, a parent would always know where a replacement pacifier would be and should the child lose one in the middle of the night and wake up crying as a result of the loss, by withdrawing one of the readily accessibly objects from the present invention, the parent has a good opportunity to readily get the child back to sleep. Thus, through use of the present invention, parents and those caring for babies and small children who find themselves continually picking up dropped objects and not always having the time or a sink or other cleansing source nearby to properly clean the objects before returning them to the child, can have a means for rapidly supplying a clean replacement object to the baby or child. There is no device known having the same features and components as the present invention, nor all of its advantages.

BRIEF SUMMARY OF THE INVENTION—OBJECTIVES AND ADVANTAGES

The primary object of this invention is to provide a compact and portable soft container configured with a top opening that is accessible to a large adult male hand and dimensioned for the storage of approximately a dozen or so pacifiers, several teething devices, and/or small baby toys. It is also an object of this invention to provide a soft container that is durable and made from washable material. A further object of this invention is to provide a soft container with quick-release fasteners that allow ready movement of the present invention to new locations. It is also an object of this invention to provide a soft container that is made at least in part from mesh or other open-weave fabric for visibility of contents and to facilitate air movement in and around the container's contents. A further objective is to provide versatile attachment means that alternatively allows the present invention container to be secured to a substantially planar surface, such as a wall, as well as to the railing of a crib or other baby-holding device.

As described herein, properly manufactured and used, the present invention provides a convenient and readily accessible storage container for holding the type of small objects needed to comfort and entertain small children. It is made at least in part from open-weave material, such as but not limited to nylon net. The remainder of the container's body and its straps can be made from any material that is soft and flexible, and incapable of harming an infant should the infant come in contact with it, such as but not limited to canvas, cotton twill, gingham, calico, polished cotton fabric, and/or plastic. The thickness of the materials used is not critical, as the weight of the items to be stored in the present invention container is not substantial. However, all materials used for construction of the present invention should be durable, non-toxic and repeatedly washable without premature deterioration so that its purchaser can maintain it as a sanitary storage container for baby items, wash it as often as needed, and enjoy its use for an extended period of time. It is contemplated for parents to use the present invention to store objects for more than one baby or small child, or perhaps for an older child to continue using it to store small objects that are frequently needed, such as hair clips and barrettes, and which may not otherwise be stored in one place for ready accessibility. The straps of the present invention are optionally removable, as it is contemplated for the hook-and-pile fasteners on the back of the soft container and which are covered by the straps when they are in place, to be used to directly attach the container to a nearby wall surface, child-supporting object, or other substantially planar location convenient to a child. Thus, an adult caring for a child could have several present invention devices attached in various locations around a house, or have several locations within the house where complementary hook-and-pile fasteners are permanently positioned whereby the user would simply move the present invention container with the child as it is moved from one room or location in the house to another. Further, the length of the straps used with the present invention container is not critical. They should be long enough for attachment of the present invention soft container to a variety of baby holding devices, such as a crib, highchair, swing, stroller, changing table, and the like. In addition, the type of fasteners used between the straps, when they are removable, and the soft container can be any type of quick-release fastener, such as but not limited to hook-and-pile fasteners, snaps, flattened waistband fasteners, and the like, as long as the fasteners do not have sharp points or edges that could harm an infant or small child. The soft present invention container should have sufficient interior volume for the storage of approximately a dozen or so pacifiers, several teething devices, and/or small baby toys, and its top opening should be sufficiently large for ready insertion therethrough of a large adult male hand. Thus, through use of the present invention, in the middle of the night a mother, father, or other family member can quickly and easily gain access to a replacement pacifier or other small comforting toy to place a crying child at ease so that it can go promptly back to sleep, for the benefit of the entire family.

While the description herein provides preferred embodiments of the present invention, it should not be used to limit its scope. For example, variations of the present invention, while not shown and described herein, can also be considered within the scope of the present invention, such as variations in the height dimension of the container; the size and configuration of the support straps; the type and number of quick-release fasteners used; the amount of nylon mesh or other open-weave fabric used for the body of the container; and the amount, color, and type of decoration that are made a part of the container and/or its straps. Thus, the scope of the present invention should be determined by the appended claims and their legal equivalents, rather than being limited to the examples given.

DETAILED DESCRIPTION OF THE INVENTION

Figure 1:
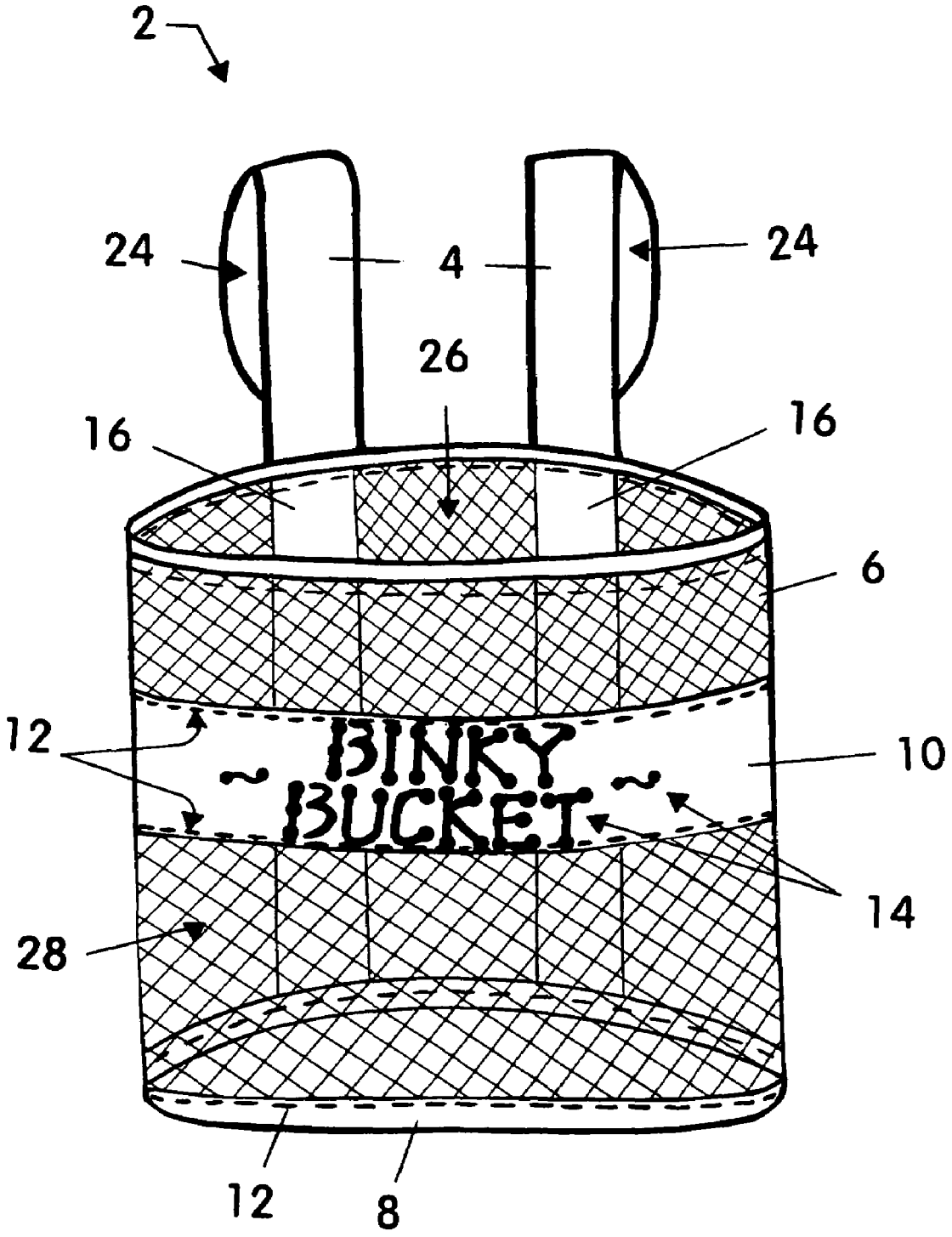
FIG. 1 is a front view of the most preferred embodiment of the present invention having a substantially cylindrical body with a wide upper opening, a bottom surface made from non-mesh material, a horizontally extending reinforcement strip with informational and design markings thereon, two rearwardly positioned and vertically extending reinforcement strips, a substantial amount of the cylindrical body having an open-weave structure, broken lines indicating areas where stitching is placed, and two straps attached to the cylindrical body each with an upper end formed into a loop.
Figure 2:
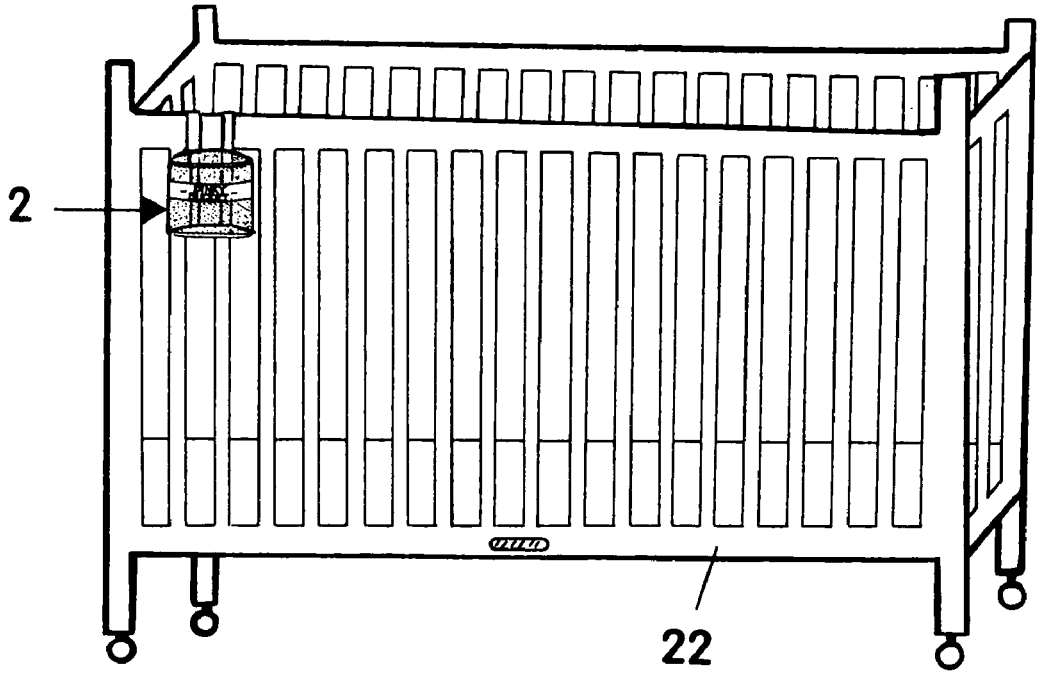
FIG. 2 is a perspective view of the most preferred embodiment of the present invention in one of its many positions of use attached to the top rail of a baby crib.
Figure 4:
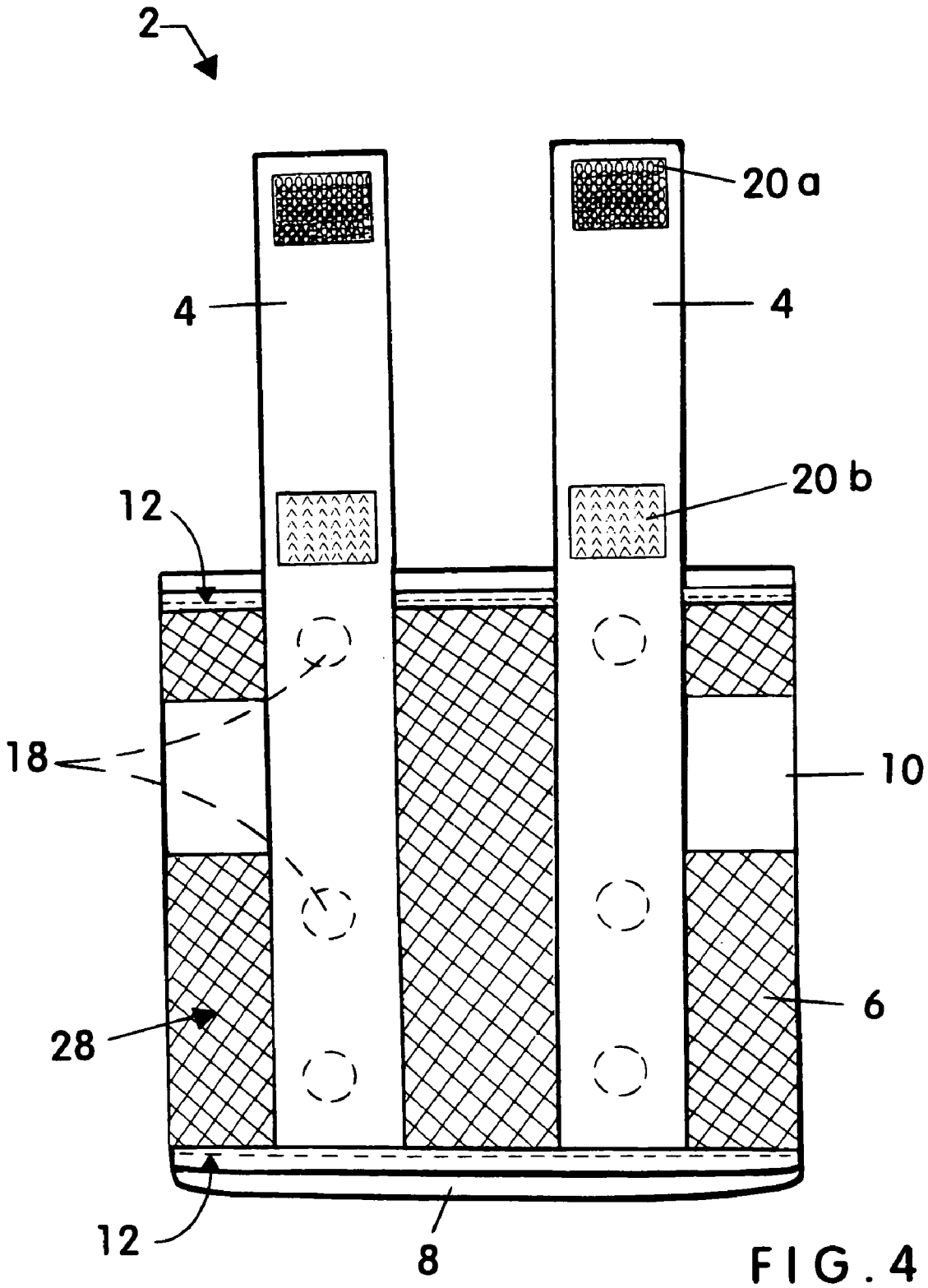
FIG. 4 is a back view of the most preferred embodiment of the present invention having a rear outside surface, two removable and vertically extending straps positioned between the opposing ends of a horizontally extending reinforcement strip, each strap being attached to the rear outside surface by a plurality of two-part quick-release fasteners which are hidden and indicated by broken lines, and both parts of an additional two-part quick-release fastener on the portion of each strap that extends above the cylindrical body which are positioned in a spaced-apart relation to one another for forming the distal end of each strap into a loop.
Figure 5:
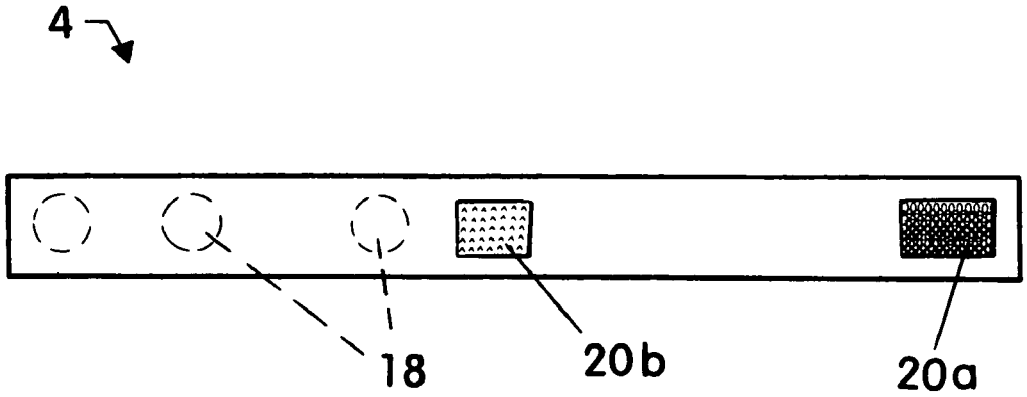
FIG. 5 is a front view of the most preferred embodiment of the present invention strap having both parts of a two-part quick-release fastener attached at a spaced apart distance from one another on the same side of the strap on one of its opposing ends, and a plurality of hidden fasteners indicated by broken lines attached to the opposing side of the strap on the other of its opposing ends.
Figure 6:
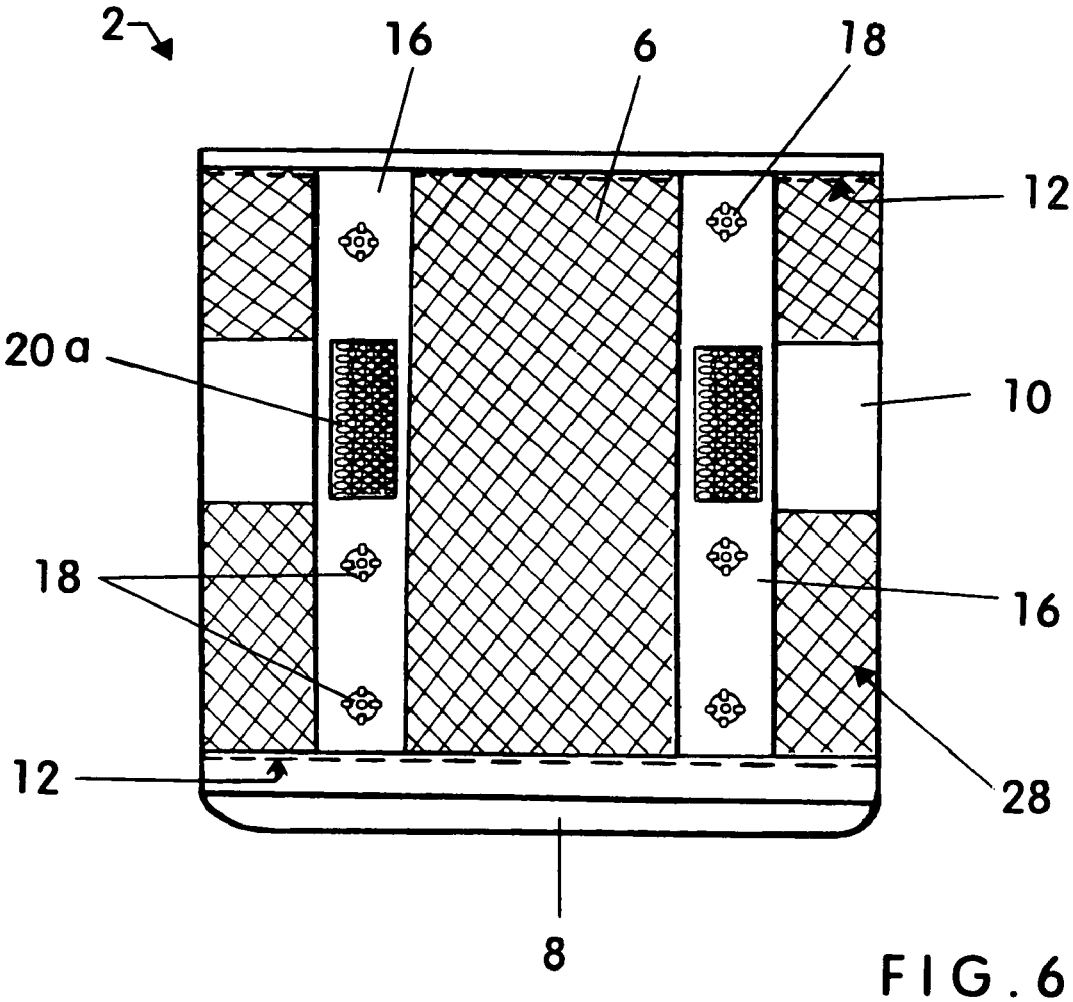
FIG. 6 is a back view of the most preferred embodiment of the present invention having its straps removed to reveal two vertically extending reinforcement strips positioned between the opposing ends of a horizontally extending reinforcement strip, a first part of three two-part quick-release fasteners attached to each vertically extending reinforcement strip, and one part of a larger two-part quick-release fastener attached to each vertically extending reinforcement strip in a position adjacent to the horizontally extending reinforcement strip for direct attachment of the container to one or more complementary fastener parts that have been previously secured to a wall or other flat surface, fabric, a fabric-covered object, or acruate surface.

FIG. 1 shows the most preferred embodiment 2 of the present invention having a substantially cylindrical main body 6 with two straps 4 extending upwardly beyond the rear perimeter edge of said main body 6. Although the number and placement of straps 4 in most preferred embodiment 2 is not critical, for convenience of use it is preferred that two straps 4 be used and that they be connected to the rear outside surface of main body 6. Also, straps 4 can be permanently or detachably connected to main body 6. If straps 4 are made removable, one or more two-part quick-release fasteners, such as but not limited to the pile fasteners 20*a* shown in FIG. 6, could be attached to the central portion of main body 6 under straps 4, where they would remain hidden and unusable while straps 4 are in place. Then, once straps 4 are removed, the newly uncovered fasteners 20*a* are available for attaching main body 6 directly to one or more hook fasteners 20*b* that have been previously secured to a wall, or other flat, smooth, fabric covered, or even arcuate surface (not shown). One example of a fabric-covered surface that could be used for support of main body 6 by direct attachment of two-part quick-release fasteners 20*a* and 20*b* is the front outside surface of a diaper bag. One or more complementary fasteners could be stitched or otherwise secured to the diaper bag so that when it is positioned close to a child, such as when it might be supported in a restaurant by a chair, main body 6 is close at hand to promptly provide replacement pacifiers and/or toys as needed to keep the child entertained and/or calm. When straps 4 are again connected to main body 6, they can be alternatively used to support main body 6, with the conversion between strap 4 support and direct attachment of main body 6 by quick-release fasteners such as 20*a* and 20*b* being nearly instantaneous and infinitely repeatable. Although pile fasteners 20*a* and hook fasteners 20*b* are individually shown in the accompanying illustrations and are meant to form a two-part fastener 20, no illustration shows them in combined form as a two-part hook-and-pile fastener that is marked solely by the number 20. However, the combination is mentioned at least once hereinafter in the disclosure as fastener or fasteners 20. Individual references to pile fastener 20*a* and hook fastener 20*b* appear many times in the ensuing description. FIG. 1 also shows the distal end of each strap 4 being formed into a looped configuration 24. Although the distal ends of straps 4 form a rearwardly oriented looped configuration, 24 and such orientation is preferred, in the alternative it is also contemplated for the distal ends of straps 4 to form the looped configuration 24 by being secured to the front surface of straps 4. As can be seen in FIGS. 4 and 5 but not limited thereto, it is contemplated for a two-part quick-release fastener, such as hook-and-pile fasteners 20*a* and 20*b*, to be used to securely and indefinitely hold the distal ends of straps 4 in their looped configurations 24 until deliberately released, so that the looped configurations 24 of one or both straps 4 can be used to suspend main body 6 and any lightweight contents (not shown) therein from a nearby and conveniently located support surface, such as but not limited to the top rail of a crib as shown in FIG. 2, or although not shown, in the alternative to a high chair, baby changing table, nearby wall surface, swing, baby play yard, and the like. The use of quick-release fasteners such as 20*a* and 20*b* to form looped configurations 24 shown in FIG. 1 is not critical, but preferred as they permit a user to rapidly and repeated move main body 6 from one location to another as the child (not shown) needing the contents stored within main body 6 is similarly moved. A temporary rather than permanent formation of looped configurations 24 is critical in the distal end of each strap 4 used, since it is contemplated for main body 6 and straps 4 to be periodically removed from their position of use for cleaning so that the interior surfaces of main body 6 can be maintained in a sanitary condition for storage of clean baby items (not shown), such as but not limited to pacifiers, small toys, and teething devices. It is contemplated for cleaning to include hand or machine laundering, as well as hand or machine drying. In embodiments where straps are detachably secured to main body 6, the stitching 12 near the upper and lower ends of main body 6 can be used to assist in the attachment of straps 4 to main body 6. Also, the configuration of straps 4 is not limited to that shown in FIG. 1. Alternative examples of strap 4 configuration could include straps 4 that are longer or shorter than the straps 4 shown in FIG. 1. Further, the number of straps 4 used could be increased or decreased beyond that shown in FIG. 1, although the spaced-apart parallel configuration of two straps 4 shown in FIG. 1 is most preferred. In addition, two or more straps 4 could be anchored from a single attachment point centered on or near to the upper edge of main body 6 between the two straps 4 shown in FIG. 1. A single attachment point would result in a V-shaped configuration of straps 4. FIG. 1 also shows two vertically extending reinforcement strips 16 as structural a part of main body 6. Although two vertically extending strips 16 are preferred, the number of vertically extending strips 16 is not critical. Thus, unless used for decorative contrast, the number of vertically extending strips 16 should not exceed that which provides structural benefit so as not to place structural integrity at risk and/or substantially increase manufacturing cost. Further, although the use of one vertically extending strip would be possible, unless it is wider than the one shown in FIG. 1, supporting main body 6 by only one vertically extending strip 16 might not allow upper opening 26 to remain in the preferable non-collapsed state shown in FIG. 1. Thus, the number and width of the strips 16 used in the present invention should be determined by the combination of number and width needed to strengthen the adjacent open-weave material 28, without being so numerous and wide as to prevent air circulation through the interior of main body 6 and/or add labor or material cost to the present invention without also adding appropriate benefit. FIG. 1 also shows main body 6 being made substantially from open-weave material and having a bottom surface 8, made from non-mesh/non-open-weave material. Although FIG. 1 shows open-weave material 28 having uniformly spaced openings, it is not critical for the open-weave material 28 used for main body 6 to be a mesh fabric with uniform openings. The only requirement for the openings in open-weave material 28 is that they be sufficiently small to contain the objects intended for storage within main body 6 and allow easy retrieval of such objects without entanglement. Further, although preferred embodiment 2 would have a bottom surface 8 made from non-mesh/non-open-weave material for the strength and stability that it would add to main body 6, alternative embodiments of the present invention could have a bottom surface 8 made from mesh or other open-weave material 28. FIG. 1 shows bottom surface 8 being secured at least in part to the remainder of main body 6 by stitching 12. It is not clear from the illustration in FIG. 1 whether stitching 12 provides the main means of attaching bottom surface 8 to the portion of main body 6 immediately above it, or whether stitching 12 merely provides reinforcement as "top stitching". Any reinforcement provided by "top stitching" would add to the durability of main body 6 so that it can sustain repeated cleaning without premature fraying of fabric edges, component separation, and/or other forms of deterioration. Use of stitching 12 as reinforcement of main body 6, to increase the amount of weight it could support, would be a secondary consideration as most of the contents (not shown) anticipated for storage in the hollow interior of main body 6 are light in weight, such as pacifiers, teething devices, and the type of soft, small, and lightweight toy anticipated for infant and small child use. Even if main body 6 is later used when the child is two or three years older, it is contemplated that main body 6 would hold lightweight objects, such as but not limited to doll accessories, transformer masks and/or weapons and other accessories, game pieces and/or multiple pairs of dice, an assortment of hair accessories to include barrettes and clips, sunglasses, small tools for assembly and disassembly of miniature skateboards and other similar toys intended for hand manipulation and/or display, an assortment of the small toys available from fast food restaurants, and the like. Although not shown, stitching 12 could be added to straps 4, vertically extending strips 16 for decorative accent and/or reinforcement to enhance durability and allow it to maintain its original shape after repeated cleaning and use. Such stitching 12 could be positioned around the perimeter, longitudinally in rows, laterally in rows, diagonally, in geometric patterns or other design configurations, and/or any other pattern or design that fulfills the manufacturer's intended structural or design purpose. The thread used for stitching 12 can be any color, so that it matches the color of straps 4 and vertically extending strips 16 or in the alternative provides a color contrast thereto. FIG. 1 further shows a horizontally extending strip 10 made from non-mesh/non-open-weave material that provides reinforcement for the adjacent open-weave/mesh material 28 and overall strength for main body 6. Strip 10 also helps to support main body 6 in a position that allows top opening 26 to remain in a substantially opened position during use for quick and easy insertion therethrough of an adult hand (not shown) for fast retrieval of contents stored within the hollow interior of main body 6. At a minimum, it is preferred that the circumference of top opening 26 is sized to allow prompt access to the contents of main body 6 by a large adult male hand. Although it is contemplated that strip 10 could completely encircle main body 6, FIG. 6 shows horizontally extending strip 10 in the most preferred embodiment 2 not extending between vertically extending strips 16. Further, while FIG. 1 shows strip 10 positioned in the bottom portion of the upper half of main body 6, such positioning is not critical and if only one horizontally extending strip 10 is present, it is contemplated only that it be positioned somewhere centrally between top opening 26 and bottom surface 8. Also, the number and width of horizontally extending strips 10 are not critical, and in place of the one strip 10 shown in FIG. 1, two or more horizontally extending strips 10 of similar or different width dimension than shown in FIG. 1 could be used as a part of main body 6. In addition to material and labor cost, as well as structural integrity, other limitations on the number and width of strips 10 used is the need for some open-weave material 28 between them for air circulation and content visibility. Thus, it is generally preferred for the present invention to contain a substantial amount of a netting, mesh, or other open-weave material 28. In addition, as shown in FIG. 1, horizontally extending strip 10 provides a surface upon which informational and design markings 14 can be placed. Information and design markings 14 can be made in any color or colors that cause it to be distinguishable from strip 10. Baby accessories typically are made in pastel colors. Therefore, the words and decorative flourishes displayed in FIG. 1 as a part of informational markings 14 could all be the same color, or a mix of different colors. In addition to the word 'BINKY BUCKET' displayed in FIG. 1, or as an alternative thereto, informational and design markings 14 can contain the baby's name, images of objects familiar to a baby, geometric shapes, animal outlines, decorative embroidery, alphanumeric markings, and/or a combination thereof. Further, although main body 6 can be made in different sizes, it is contemplated for the hollow interior of main body 6 in preferred embodiment 2 to hold approximately a dozen or so pacifiers, several teething devices, and/or small soft baby toys (not shown).

FIG. 2 shows the most preferred embodiment 2 of the present invention attached to the top rail of a baby crib 22 near to one of its ends. In the alternative, most preferred embodiment 2 can be centered along the top rail of crib 22, attached to one of the ends of crib 22, or placed on crib 22 in any position that is convenient for the user. If straps 4 are crossed in the back so that the distal fastener 20*a* or 20*b* is connected to the complementary fastener 20*a* or 20*b* on the opposing strap 4, main body 6 can even be secured around a vertical bar on crib 22 or other child-holding apparatus. When straps 4 are so engaged on a vertical bar on crib 22, it is expected for main body 6 to be located close to the bottom rail of crib 22 or for straps 4 to be in contact with a mattress (not shown) supported adjacent to the bottom rail of crib 22. For larger children, the upper opening 26 of most preferred embodiment 2 could be placed at mattress level with crossed straps 4, and within a child's reach, so that when the child wakes up he or she could at least occasionally find a pacifier or comforting toy without parental assistance. Further, if straps 4 are removable from main body 6, most preferred embodiment 2 can be attached directly to one of the ends of crib 22 or a wall surface adjacent to crib 22. However, it is not contemplated for most preferred embodiment 2 to be limited to use on or around a child's crib 22, as shown in FIG. 2. In the alternative, most preferred embodiment 2 could be attached to a changing table, highchair, swing, rocking chair, portable play yard, stroller, or any other baby-holding device. Additionally, if a complementary portion of a two-part quick-release fastener is stitched or otherwise secured to a fabric surface, it is considered to be within the scope of the present invention for main body 6 to be directly attached to a fabric covered surface or one comprising fabric, such as the front or end panels of a diaper bag. Further, since it is contemplated for the present invention to have several positions of need around a home, such as but not limited to the child's bedroom, dining area, and/or a room where the child is often allowed to play, a single present invention can be moved from room to room with the child, or in the alternative the user can purchase several preferred embodiments 2 and leave each permanently in a selected place of use where it is determined in advance that it would be conveniently accessible and of most assistance to the parent or other caregivers for the child. Particularly for night use, once the most desired position for the present invention is established, it should be left in that same position night after night so that a sleepy parent awakened by a crying child who has lost a pacifier or other comforting toy knows instinctively where to go to find a clean replacement, and thereby can quickly replace the lost item and be able to promptly return to bed. In addition to home use, the present invention is also contemplated for use by hospitals, nurseries, and other child caring facilities so that a substitute sanitary pacifier, teething device or toy can be given to a child for comforting purposes, even when the caregiver does not have time to stop and find or clean the one that the child has dropped on the floor.

Figure 3:
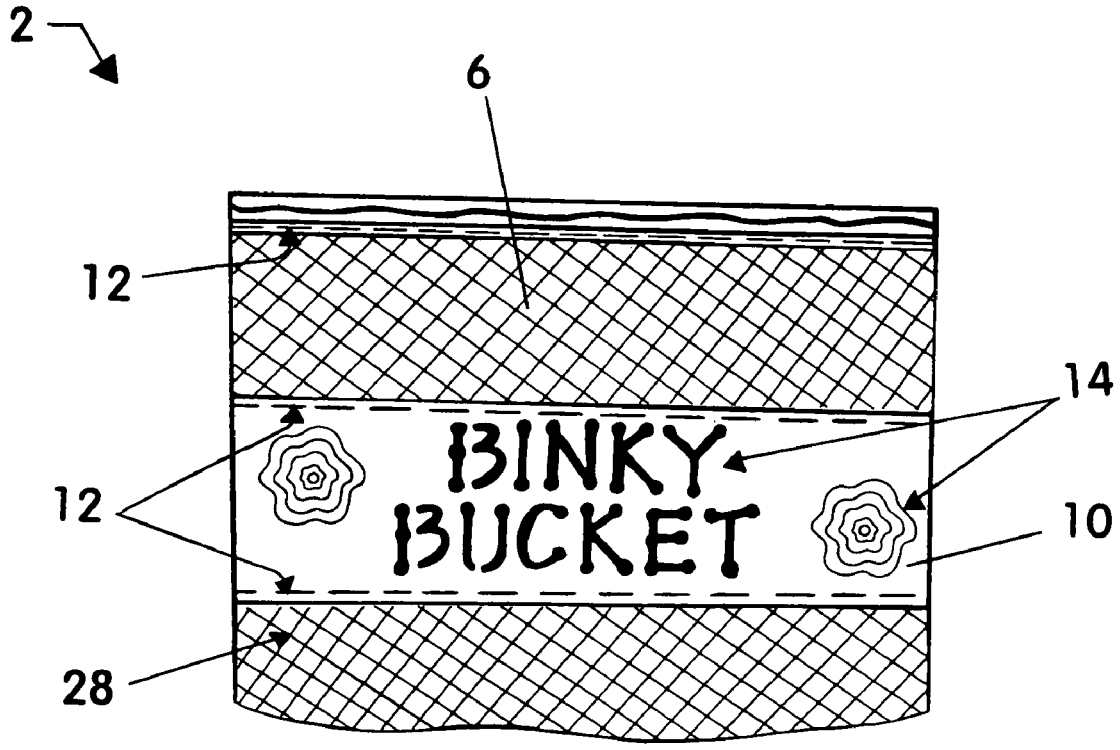
FIG. 3 is an enlarged view of the upper portion of the most preferred embodiment of the present invention container made substantially from open-weave material, broken lines indicating areas where stitching is placed, and informational and design markings located on a horizontally extending reinforcement strip.

FIG. 3 shows an enlarged view of the upper end of most preferred embodiment 2. One strip 10 extends horizontally across main body 6, with mesh/open-weave material 28 situated above and below strip 10. Although one strip 10 centrally positioned on main body 6 is preferred, it is contemplated for more than one horizontally extending strip 10 to be used in most preferred embodiment 2. Although not shown, one or more vertically extending strips 16 could be added as desired or needed to the front portion of main body 6 for decorative purposes, or to strengthen or stiffen the front portion of main body 6 as needed so that the top opening 26 shown in FIG. 1 remains substantially open for ready accessibility by a large adult male hand to the baby/child objects temporarily stored within the hollow interior of main body 6. Further, although the vertically extending reinforcement strips 16 typically attached to the rear surface of main body 6 are not shown in FIG. 3 through mesh/open-weave material 28, one or more strips 16 larger or smaller than shown in FIGS. 1 and 6 would be seen through mesh/open-weave material 28 behind horizontally extending strip 10. Also, informational and design markings 14 are displayed in FIG. 3 on strip 10, in the form of the words "BINKY BUCKET" and two generally flower-shaped designs positioned to the right and left of the words. The type of informational/design markings 14 used in the present invention on horizontally extending strip or strips 10 and any vertically extending strips 16 is not critical and can include but are not limited to a wide variety of familiar cartoon characters, numbers, alphanumeric markings, animals, birds, fish, flowers, and/or whimsical designs. In addition, it is considered to be within the scope of the present invention for informational/design markings 14 to be on any part of most preferred embodiment 2, including straps 4 and mesh/open-weave material 28. Further, FIG. 3 shows stitching 12 providing a connection between strip 10 and mesh/open-weave material 28 and also a connection between mesh/open-weave material 28 and the reinforced top edge of main body 6. Stitching 12 can contain one or more threads, and have a color that matches the color of horizontally extending strip 10 and/or mesh/open-weave material 28. In the alternative, stitching 12 can comprise contrasting colors to provide a decorative accent. Since the objects contemplated for temporary storage within main body 6, such as but not limited to pacifiers, are typically more than one inch in their length, width, and thickness dimensions, the mesh/open-weave material 28 can have larger openings than are shown in FIG. 3 without creating entanglement difficulties that would otherwise be expected to occur if main body 6 had larger openings and was used to store objects having a length or width dimension less than one-half of an inch. Thus, a determination as to the size of the openings used in the mesh/open-weave material 28 should be made considering whether it is desired for main body 6 to be used for other types of storage as the child grows up, and typically how small the non-infant items contemplated for such storage might be.

FIG. 4 shows the back surface of most preferred embodiment 2 with its two straps 4 still attached to main body 6 in a substantially parallel configuration. The distal ends of each strap 4 is extended to reveal a two-part quick-release fastener, identified in FIG. 4 by the numerical designations 20*a* and 20*b*. Although the hook portion 20*b* of the two-part quick-release fastener is shown on the proximal end of each strap 4, with the complementary pile portion 20*a* of the two-part quick-release fastener being secured on the distal end of each strap 4, it is also contemplated for reverse positioning of fastener parts 20*a* and 20*b* to be used. When they are fastened together, hook portion 20*b* and pile portion 20*a* cause the distal ends of each strap 4 to form a looped configuration 24 that extends upwardly beyond the top perimeter of main body 6. However, although FIG. 4 shows hook-and-pile fasteners 20*a* and 20*b* being used, the type, size, configuration, and number of two-part quick-release fasteners employed to place the distal ends of each strap 4 into a looped configuration 24 are not critical, as long as such fasteners securely form the needed looped configurations 24 and continue to do so until intentionally released. Also, the length of straps 4 and the measured distance on straps 4 between fasteners 20*a* and 20*b* is not critical and can be different from that shown in FIG. 4, as long as the looped configurations 24 are sufficient in size to conveniently and rapidly attach main body 6 to, and remove it from, intended support surfaces (not shown). FIG. 4 shows both fasteners 20*a* and 20*b* being positioned on the same side of each strap 4 so that straps 4 do not need to be twisted to form their looped configurations 24. FIG. 4 further shows the bottom surface 8 of main body 6 being made from non-open-weave material, and straps 4 being positioned between the opposing ends of horizontally extending strip 10. In addition, FIG. 4 shows mesh/open-weave material 28 being located above and below horizontally extending strip 10, as well as between straps 4. Top stitching 12 is shown near the top edge of main body 6, as well as on the perimeter edge of bottom surface 8. It is contemplated for top stitching 12 to provide reinforcement of main body 6 for durability and extended use thereof after repeated cleaning, and/or a decorative accent to make preferred embodiment more aesthetically appealing to enhance its sale. FIG. 4 also reveals three hidden fasteners 18 (shown in broken lines) used to secure each strap 4 to main body 6. It is contemplated for hidden fasteners 18 to be two-part quick-release fasteners, such as but not limited to snaps, although hook-and-pile fasteners 20*a* and 20*b* or other fasteners having a configuration with no sharp edges or points able to harm a child could be used instead. In embodiments of the present invention where straps 4 are permanently attached to main body 6, quick-release fasteners 18 would not be required. Although not shown in FIG. 4, straps 4 are usually not secured to mesh/open-weave material 28. Instead, as shown in FIGS. 1 and 6, at least one vertically extending strip 16 is typically positioned under each strap 4 to support it and contain the second parts of the quick-release two-part fasteners 18 attached to straps 4. The number of fasteners 18 used to attach each strap 4 to main body 6 is not critical and would depend at least in part on the length dimension of main body 6, with larger main bodies 6 perhaps requiring more fasteners 18. However, it is not contemplated for a surplus number of fasteners 18 to be used on any main body 6 without appropriate support benefit.

FIG. 5 shows a strap 4 separated from main body 6 and having two types of fasteners 18 and 20 attached thereto. Both types of fasteners, 18 and 20, should be quick-release two-part fasteners for most convenient use. FIG. 5 shows fasteners 20*a* and 20*b* being spaced apart from one another on one side of strap 4 and occupying approximately one-half the longitudinal length of strap 4. Pile fastener 20*a* is located near to the end of strap 4, while hook fastener 20*b* is located close to the center portion of strap 4. A reverse positioning of fasteners 20*a* and 20*b* is also considered to be within the scope of the present invention. The connection of fastener 20*a* to fastener 20*b* forms each strap 4 into a looped configuration 24 that can be used to suspend main body 6 from the top railing of a crib 22 or other baby-holding device (not shown). Fasteners 18 are located on the reverse side of strap 4 from fasteners 20*a* and 20*b*, and are used to secure strap 4 to main body 6. FIG. 5 shows fasteners 18 being positioned so that one fastener 18 will secure strap 4 near to the top edge of main body 6, a second fastener 18 will secure strap 4 near to bottom end 8, and a third fastener will secure the central portion of strap 4 to main body 6. In FIG. 5, the two fasteners 18 most remote from fasteners 20*a* and 20*b* appear to have a smaller spaced apart distance between them than that observed between the fastener 18 closest to the center of strap 4 and the middle fastener 18. The wider spacing between the inner two fasteners 18 provides room for the positioning of a pile fastener 20*a* on the vertically extending reinforcement strip 16 that supports the attachment of strap 4 to main body 6 (see the pile fastener 20*a* positioned between fasteners 18 in FIG. 6). However, the number and spaced apart distances of fasteners 18 are not limited to that shown in FIG. 5. Also, although FIG. 5 shows strap 4 having a substantially rectangular configuration, other configurations are considered to be within the scope of the present invention, such as but not limited to straps 4 with scalloped or other arcuate perimeter edges, a rounded or chamfered distal end, and/or a pinked perimeter edge. Further, it is contemplated for straps 4 in the most preferred embodiment of the present invention to be made from a thin and flexible material that is easily manipulated, and which is also sturdy and washable.

FIG. 6 shows the rear surface of most preferred embodiment 2 without its removable straps 4, and reveals an additional pile fastener 20*a* (not identified in FIG. 4) on each vertically extending strip 16. It is contemplated for such fasteners 20*a* to be used for direct attachment of main body 6 to one or more hook fasteners 20*b* (not shown) secured by adhesive or other means to a wall or other substantially planar, smooth, fabric-covered, and/or even arcuately configured support surface (not shown). It is contemplated in preferred embodiment 2 for any type of quick-release two-part fastener to be used for a strapless direct attachment of main body 6 to a nearby support surface, as long as the fasteners selected do not have sharp points or edges that might injure a baby or small child. Examples of contemplated fasteners include but are not limited to large snaps and the type of rounded waistband hooks used in the manufacture of pants and skirts. Further, when hook-and-pile fasteners 20*a* and 20*b* are used in any application in the present invention, the positioning of each on straps 4 and strips 16 is interchangeable as long as a complementary fastener 20*a* or 20*b* is properly positioned to engage it. FIG. 6 further shows stitching 12 used to secure bottom surface 8 and the upper edge of main body 6 to mesh/open-weave material 28, as well as secure fasteners 18 to vertically extending strips 16 even though a numerical marking of the threads used to secure fasteners 18 to vertically extending strips 16 is not present. Although not shown, either stitching 12, adhesive or bonding means, or a combination thereof, can be used to secure pile fastener 20*a* to vertically extending strips 16. FIG. 6 also shows pile fasteners 20*a* being positioned adjacent to horizontally extending strip 10, which is preferred, and horizontally extending strip 10 not being extended between the substantially parallel vertically extending strips 16. In alternative embodiments of the present invention, it is considered to be within the scope of the present invention for horizontally extending strip 10 to fully encircle main body 6, and/or for more than one horizontally extending strip 10 to be present.

One way to use the present invention would be to first secure straps 4 to main body 6 with fasteners 18. Then a user would select a supporting device (not shown except for crib 22) for main body 6, such as but not limited to a crib 22, high chair, baby swing, stroller, changing table, and the like. Once the distal ends of straps 4 are positioned around or through a rail, bar, opening, slit, notch, or other feature on the supporting device that would allow straps 4 to wrap around or through it, the user would join together the fasteners 20*a* and 20*b* on the unattached portion of at least one strap 4 to form a looped configuration 24, with main body 6 then being supported the looped configurations 24. Once hung in this manner, the top opening 26 that leads to the hollow interior of main body 6 is maintained in a substantially open position and main body 6 can be filled with approximately dozen or so sanitary pacifiers, several teething devices, and/or small toys that comfort a child and can promptly be used to replace similar objects that have become dirty or lost. In the alternative, although not shown, main body 4 can be mounted directly to a wall or other support surface without straps 4. One or more hook or pile fasteners 20*b* or 20*a* is first secured by an adhesive backing to a wall, side or back surface of a high chair in a position out of the reach of a child using the high chair, side surface of a changing table, back of a swing, front or end of a diaper bag, or other conveniently located surface. The complementary pile or hook fasteners 20*a* or 20*b* on the rear surface of main body 6 are then directly mated with the previously hung fasteners 20*b* and/or 20*a* for a secure mounting of main body 6 to the support surface during the needed term of use. Transfer of main body 6 and any contents therein (not shown) to a new location involves separation of the complementary fasteners 20*a* and 20*b*, and then a repeat of the steps above once main body 6 arrives at the new location. If main body 6 is used at a first location without straps 4, at the new location straps 4 may be attached and used for support of main body 6, or visa versa. Although illustrations herein show fasteners 20*a*, 20*b*, and 18 respectively being hook-and-pile fasteners and snaps, it is contemplated for either to be replaced by the other or any other common type of fastening means that is able to accomplish the same secure fastening purpose without injury to an infant or small child. Further, while it is contemplated for any part of the present invention to have any color, pattern, or soft surface texture, it is preferred that the colors, patterns, and textures used for straps 4, open-weave material 28, fasteners 20*a*, 20*b*, and 18, vertically extending strips 16, and horizontally extending strips 10 be consistent with the decor typically used in the room of an infant or small child.

I claim:

1. A container for the temporary storage of clean and sanitary pacifiers, teething devices, small toys, and other small baby-related objects that in a baby's or child's possession are frequently drooled on, dropped on the ground, covered with food, and/or otherwise in need of cleaning prior to being returned to the baby or child, said container comprising:

a substantially cylindrical non-stretching main body having a hollow interior, a height dimension, a bottom portion, a top portion, a top opening with a minimum circumference configured to allow insertion therethrough of a large adult male hand, said main body also having at least one rearwardly-positioned vertically extending structural strip integral to said main body that is configured and positioned to prevent collapse of said top opening, said at least one vertically extending strip extending substantially across said height dimension, at least one horizontally extending structural strip integral to said main body and at a minimum substantially encircling said main body, said at least one horizontally extending strip structurally joined to said at least one vertically extending strip; with open-weave material configured to allow air circulation through said main body adjacent to and adjoining said at least one horizontally extending strip and said at least one vertically extending strip, and further with said open-weave material forming a majority of said main body between said top and bottom portions thereof, with all materials used for construction of said main body being flexible, soft-textured, and washable while at the same time having a sufficient thickness dimension that enables said top opening in said main body to remain open at all times for prompt and direct user access to contents stored within said hollow interior, and further with said strips and said top portion being made from non-open-weave materials; and quick-release fastening means adapted to temporarily and securely attach said main body and any contents therein to a supporting structure conveniently situated to a commonly used child care location, said quick-release fastening means being connected to said main body so that any sanitary baby-related objects placed therein remain sanitary, and are readily and directly accessible to people caring for babies and small children for prompt delivery to a baby or child in need of one for comfort.

2. The device of claim 1 wherein said quick-release fastening means is selected from a group consisting of straps permanently attached to and structurally integral with said main body as vertically extending strips, elongated straps, detachable straps configured for quick-release connection to said at least one vertically extending strip, two-part hook-and-pile fasteners, and snaps.

3. The device of claim 2 comprising at least one detachable strap and wherein said at least one detachable strap comprises an upper end, and further wherein said quick-release fastening means comprises at least one quick-release two-part first fastener configured for connecting said at least one detachable strap to said at least one vertically extending strip, and wherein said quick-release fastening means further comprises at least one second quick-release two-part fastener configured for securely forming said upper end of said at least one strap into a closed loop that is usable in repeatedly attaching and reattaching said main body to baby and child supporting devices and other objects near to child care locations that are configured for securely supporting said main body by said at least one closed loop.

4. The device of claim 3 wherein said main body has a back surface and at least one vertically extending structural strip of non-open-weave material integral with said back surface, and further wherein said at least one quick-release two-part first fastener configured for connecting said at least one strap to said main body secures said at least one strap to said at least one vertically extending strip.

5. The device of claim 3 wherein said main body has a back surface and at least one vertically extending structural strip of non-open-weave material integral with said back surface, and further wherein said quick-release fastening means comprises at least one quick-release two-part fastener a first part of which is secured to said at least one vertically extending strip, with the second part of said at least one quick-release two-part fastener attached to a support surface so that said main body via said at least one vertically extending strip is attachable directly to said support surface without the use of any straps.

6. The device of claim 1 wherein said main body has a back surface and at least one vertically extending structural strip of non-open-weave material integral with said back surface, and further wherein said quick-release fastening means comprises at least one quick-release two-part fastener a first part of which is secured to said at least one vertically extending strip, with the second part of said at least one quick-release two-part fastener attached to a support surface so that said main body via said at least one vertically extending strip is attachable directly to said support surface without the use of straps.

7. The device of claim 1 further comprising markings selected from a group consisting of informational markings and design markings.

8. The device of claim 3 comprising at least two detachable straps and wherein said quick-release fastening means is adapted for connecting each said strap to itself to form a loop to attach said main body to a horizontally extending structure, also adapted for connecting said straps to one another in an overlapping configuration to attach said main body to a vertically extending structure, and further adapted for connecting said main body directly to a vertically extending planar support structure without the use of said straps.

9. The device of claim 8 further comprising markings placed on said at least one horizontally extending strip of non-open-weave material and wherein said markings are selected from a group consisting of informational markings and design markings.

10. The device of claim 1 further comprising a bottom surface made from materials selected from a group consisting of non-open-weave material and open-weave material.

11. A container for the temporary storage of clean and sanitary pacifiers, teething devices, small toys, and other small baby-related accessories that in a baby's or child's possession are frequently drooled on, dropped on the ground, covered with food, and/or otherwise in need of cleaning prior to being returned to the baby or child, said container comprising:

a compact main body configured without sharp corners and having a hollow interior, a top portion, and a bottom portion, said main body also having a top opening configured for direct and immediate access of a large adult male hand to baby-related accessories placed within said hollow interior, and said main body further having at least one rearwardly-positioned vertically extending structural strip integral to said main body that is configured and positioned to prevent collapse of said top opening, said at least one vertically extending strip extending substantially across said main body, at least one horizontally extending structural strip integral to said main body and at a minimum substantially encircling said main body, said at least one horizontally extending strip structurally joined to said at least one vertically extending strip; with open-weave material configured to allow air circulation through said main body and not entangle contents positioned adjacent to and adjoining said at least one horizontally extending strip and said at least one vertically extending strip, and further with said open-weave material forming a majority of said main body between said top and bottom portions thereof;

at least one strap depending from said main body and selected from a group consisting of straps integral with said main body and forming a vertically extending structural strip and straps detachably connected to said main body via said at least one vertically extending strip, said at least one strap having an unattached portion and quick-release fastening means secured to said unattached portion by which said unattached portion is optionally formed into a looped configuration usable for suspended attachment of said main body to the top rail of a baby crib; and said main body and said at least one strap being made from materials that are flexible, soft-textured, and washable so that without injury to babies and small children said at least one strap can temporarily secure said main body to cribs and other baby-holding devices while sanitary baby-related accessories placed within said main body become immediately available to a people caring for babies and small children and needing such accessories.

12. The device of claim 11 wherein said at least one strap is repeatedly detachable from said main body.

13. The device of claim 11 wherein said main body has a back surface and further comprising at least one additional two-part fastener attached to said back surface that is configured for directly securing said back surface to a support surface.

14. The device of claim 11 further comprising markings on said main body that are selected from a group consisting of informational markings and design markings.

15. A method for making a temporary storage container for pacifiers, teething devices, and other small toys that babies and small children often drool on, drop on the ground, cover with food, and/or otherwise need cleaning prior to being returned to the child, said method comprising the steps of:

providing a quantity of flexible, soft, and washable reinforcement material, a quantity of flexible, soft, and washable open-weave material adapted to allow air circulation therethrough without entanglement of small items used for the comfort and entertainment of babies and small children, a quantity of non-open-weave material; material attachment means, and a plurality of quick-release fasteners;

using said quantity of non-open-weave material, said open-weave material, and said material attachment means to create a substantially cylindrical main body having a hollow interior, no sharp corners, and a top opening with a minimum circumference configured to allow insertion therethrough of a large adult male hand, while at the same time creating said main body with at least one rearwardly-positioned vertically extending structural strip integral to said main body that is configured and positioned to prevent collapse of said top opening, and further with said at least one vertically extending strip extending substantially across said main body, concomitantly creating said main body with at least one horizontally extending structural strip integral to said main body and at a minimum substantially encircling said main body, and further with said at least one horizontally extending strip structurally joined to said at least one vertically extending strip; and also creating said main body with open-weave material positioned adjacent to and adjoining said at least one horizontally extending strip and said at least one vertically extending strip, and further with said open-weave material forming a majority of said main body so that said top opening maintains its integrity during use for convenient user access to any contents stored within said main body.

16. The method of claim 15 wherein said quick-release fasteners are selected from a group consisting of adhesives, glues, bonding agents, snaps, two-part fasteners, hook-and-pile fasteners, and heat-activated bonding substances, and further comprising a step of securing at least a portion of said quick-release fasteners to said at least one vertically extending strip in a position where they are adapted to temporarily and securely attach said main body to a supporting structure.

17. The method of claim 15 further comprising the steps of providing marking means, and using said marking means to create informational markings on said main body.

18. The method of claim 15 further comprising the steps of making at least one strap from said non-open-weave material and attaching said at least one strap to said at least one vertically extending strip.

19. The method of claim 18 further comprising a step of providing at least one quick-release two-part fastener and a step of securing said at least one quick-release two-part fastener between said at least one vertically extending strip and said strap so that said strap is repeatedly detachable.

20. The method of claim 15 further comprising the steps of providing filament adapted for topstitching use and using said filament to create topstitching selected from a group consisting of top stitching on straps and top stitching on said main body.

* * * * *